US011111807B2

(12) United States Patent
Seymour et al.

(10) Patent No.: US 11,111,807 B2
(45) Date of Patent: Sep. 7, 2021

(54) ABRADABLE LAYER WITH GLASS MICROBALLOONS

(71) Applicant: United Technologies Corporation, Farmington, CT (US)

(72) Inventors: Kevin Seymour, Hartford, CT (US); Christopher W. Strock, Kennebunk, ME (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 16/717,458

(22) Filed: Dec. 17, 2019

(65) Prior Publication Data

US 2020/0141260 A1 May 7, 2020

Related U.S. Application Data

(63) Continuation of application No. 15/496,839, filed on Apr. 25, 2017, now Pat. No. 10,526,908.

(51) Int. Cl.
*F01D 11/12* (2006.01)
*F01D 5/02* (2006.01)
(Continued)

(52) U.S. Cl.
CPC ..... *F01D 11/122* (2013.01); *C23C 4/134* (2016.01); *F01D 5/02* (2013.01); *F04D 29/083* (2013.01);
(Continued)

(58) Field of Classification Search
CPC ..... F01D 11/122; F01D 11/125; F01D 11/12; F01D 11/127; F01D 5/02; F01D 5/288;
(Continued)

(56) References Cited

U.S. PATENT DOCUMENTS 4,704,332 A 11/1987 Brennan et al.
5,472,315 A 12/1995 Alexander et al.
(Continued)

FOREIGN PATENT DOCUMENTS

EP 2169026 3/2010
EP 3091099 11/2016
(Continued)

OTHER PUBLICATIONS

Avramov, I., Vassilev, Ts, Penkov, I. (2004). The glass transition temperature of silicate and borate glasses. Journal of Non-Crystalline Solids. vol. 351. 2005. pp. 472-476.
Extended European Search Report for European Patent Application No. 18168973.8 dated Sep. 13, 2018.
(Continued)

*Primary Examiner* — George C Jin
(74) *Attorney, Agent, or Firm* — Carlson, Gaskey & Olds, P.C.

(57) ABSTRACT

A gas turbine engine includes a circumferential row of blades, with the blades having respective blade tips. A seal is disposed about the blades. The seal has an abradable layer which the tips of the blades, at times, rub against when the blades rotate. The rubbing produces a maximum temperature at the abradable layer. The abradable layer includes a metal matrix and microballoons dispersed in the metal matrix. The microballoons are formed of a glass that has a glass transition temperature that is approximately 50° F. to 300° F. greater than the maximum temperature.

19 Claims, 2 Drawing Sheets

(51) Int. Cl.
*F04D 29/32* (2006.01)
*F04D 29/08* (2006.01)
*C23C 4/134* (2016.01)

(52) U.S. Cl.
CPC ..... *F04D 29/324* (2013.01); *F05D 2220/32* (2013.01); *F05D 2250/241* (2013.01); *F05D 2300/173* (2013.01); *F05D 2300/177* (2013.01); *F05D 2300/2102* (2013.01); *F05D 2300/6032* (2013.01); *F05D 2300/61* (2013.01)

(58) Field of Classification Search
CPC .... F04D 29/526; F04D 29/023; F04D 29/324; F04D 29/083; F04D 25/005; F05D 2300/2102; F05D 2300/501; F05D 2300/177; F05D 2300/173; F05D 2200/32; C04B 41/5027; C04B 41/87; C23C 24/10; C23C 4/08; C23C 4/18; C23C 4/02; C23C 4/06; B22F 3/1017; B22F 5/009
See application file for complete search history.

(56) References Cited

U.S. PATENT DOCUMENTS

| | | | | |
|---|---|---|---|---|
| 6,916,529 | B2 * | 7/2005 | Pabla | C23C 4/06 428/325 |
| 2006/0257485 | A1 | 11/2006 | Kumacheva | |
| 2008/0274336 | A1 | 11/2008 | Merrill et al. | |
| 2015/0139787 | A1 | 5/2015 | Le Biez et al. | |
| 2015/0275679 | A1 | 10/2015 | Strock | |
| 2015/0322809 | A1 | 11/2015 | Strock | |
| 2016/0168663 | A1 | 6/2016 | Watson et al. | |
| 2016/0326622 | A1 | 11/2016 | Strock | |
| 2016/0327059 | A1 | 11/2016 | Amini | |
| 2016/0333717 | A1 | 11/2016 | Strock | |

FOREIGN PATENT DOCUMENTS

| | | |
|---|---|---|
| WO | 2014120116 | 8/2014 |
| WO | 2015123274 | 8/2015 |

* cited by examiner

ABRADABLE LAYER WITH GLASS MICROBALLOONS

CROSS-REFERENCED TO RELATED APPLICATION

This application claims priority to U.S. patent application Ser. No. 15/496,839 filed Apr. 25, 2017.

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

The high pressure turbine drives the high pressure compressor through an outer shaft to form a high spool, and the low pressure turbine drives the low pressure compressor through an inner shaft to form a low spool. The fan section may also be driven by the low inner shaft. A direct drive gas turbine engine includes a fan section driven by the low spool such that the low pressure compressor, low pressure turbine, and fan section rotate at a common speed in a common direction.

A speed reduction device, such as an epicyclical gear assembly, may be utilized to drive the fan section such that the fan section may rotate at a speed different than the turbine section. In such engine architectures, a shaft driven by one of the turbine sections provides an input to the epicyclical gear assembly that drives the fan section at a reduced speed.

SUMMARY

A gas turbine engine according to an example of the present disclosure includes a circumferential row of blades. The blades have respective blade tips, and there is a seal disposed about the blades. The seal has an abradable layer which the tips of the blades, at times, rub against when the blades rotate. There is a maximum temperature at the abradable layer without rubbing. The abradable layer includes a metal matrix, and microballoons dispersed in the metal matrix. The microballoons are formed of a glass that have a glass transition temperature that is approximately 50° F. to 300° F. greater than the maximum temperature.

In a further embodiment of any of the foregoing embodiments, the metal matrix is formed from an alloy selected from the group consisting of nickel- or cobalt-based alloy, copper-based alloy, and aluminum-based alloy, and the microballoons are formed of a glass selected from the group consisting of fused quartz glass, soda-lime glass, fluoroaluminate glass, borosilicate, tellurium dioxide glass, and thermoset polymer glass.

In a further embodiment of any of the foregoing embodiments, the alloy is nickel- or cobalt-based alloy.

In a further embodiment of any of the foregoing embodiments, the alloy is copper-based alloy.

In a further embodiment of any of the foregoing embodiments, the alloy is aluminum-based alloy.

In a further embodiment of any of the foregoing embodiments, the glass is fluoroaluminate glass.

In a further embodiment of any of the foregoing embodiments, the glass is tellurium dioxide glass.

In a further embodiment of any of the foregoing embodiments, the glass is borosilicate glass.

The gas turbine engine as recited in claim 2, wherein the glass is soda-lime glass.

The gas turbine engine as recited in claim 2, wherein the glass is fused quartz glass.

In a further embodiment of any of the foregoing embodiments, the abradable layer has, by volume, 10-60% of the microballoons.

In a further embodiment of any of the foregoing embodiments, the abradable layer further comprises a lubricant.

In a further embodiment of any of the foregoing embodiments, the circumferential row of blades are part of a compressor or turbine section of the gas turbine engine.

A gas turbine engine according to an example of the present disclosure includes first and second circumferential rows of blades. The blades have respective blade tips, and there are first and second seals disposed about, respectively, the first and second circumferential rows of blades. The first and second seals have, respectively, first and second abradable layers which the tips of the blades, at times, rub against when the blades rotate. The first abradable layer has a first metal matrix, and first microballoons dispersed in the first metal matrix. The second abradable layer has a second metal matrix, and second microballoons dispersed in the second metal matrix. The first and second microballoons are formed of, respectively, first and second different glasses having different glass transition temperatures.

In a further embodiment of any of the foregoing embodiments, the metal matrix is formed from an alloy selected from the group consisting of nickel- or cobalt-based alloy, copper-based alloy, and aluminum-based alloy, and the microballoons are formed of a glass selected from the group consisting of fused quartz glass, soda-lime glass, fluoroaluminate glass, borosilicate, tellurium dioxide glass, and thermoset polymer glass.

In a further embodiment of any of the foregoing embodiments, the first metal matrix and the second metal matrix are the same alloy.

In a further embodiment of any of the foregoing embodiments, at least one of the first and second different glasses is fused quartz.

In a further embodiment of any of the foregoing embodiments, at least one of the first and second different glasses is soda-lime glass.

In a further embodiment of any of the foregoing embodiments, at least one of the first and second different glasses is fluoroaluminate glass.

In a further embodiment of any of the foregoing embodiments, at least one of the first and second different glasses is tellurium dioxide glass.

In a further embodiment of any of the foregoing embodiments, at least one of the first and second different glasses is borosilicate glass.

In a further embodiment of any of the foregoing embodiments, at least one of the first and second different glasses is thermoset polymer glass.

In a further embodiment of any of the foregoing embodiments, the different glass transition temperatures differ by at least 200° F.

In a further embodiment of any of the foregoing embodiments, the first and second circumferential rows of blades are part of a compressor or turbine section of the gas turbine engine.

A seal according to an example of the present disclosure includes an abradable layer that has a metal matrix selected from the group consisting of nickel- or cobalt-based alloy, copper-based alloy, and aluminum based alloy, and microballoons dispersed in the metal matrix. The microballoons are formed of a glass selected from the group consisting of fused quartz glass, soda-lime glass, fluoroaluminate glass, borosilicate glass, tellurium dioxide glass, and thermoset polymer glass.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
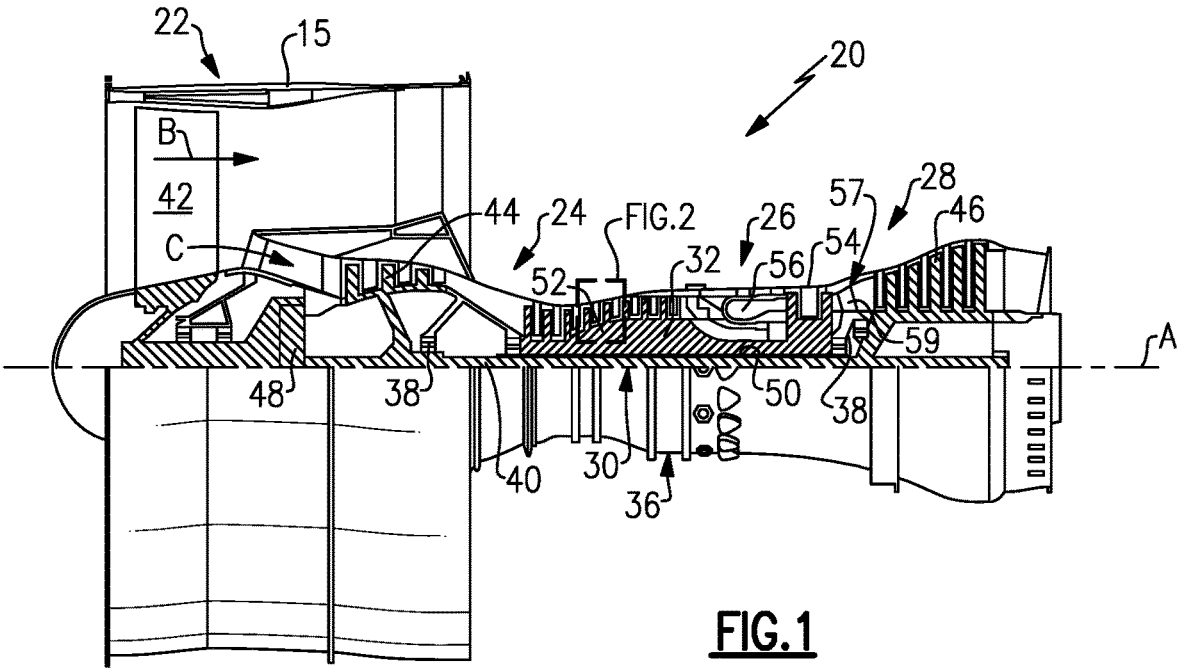
FIG. 1 illustrates an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engine designs can include an augmenter section (not shown) among other systems or features.

The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, the examples herein are not limited to use with two-spool turbofans and may be applied to other types of turbomachinery, including direct drive engine architectures, three-spool engine architectures, and ground-based turbines.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48, to drive the fan 42 at a lower speed than the low speed spool 30.

The high speed spool 32 includes an outer shaft 50 that interconnects a second (or high) pressure compressor 52 and a second (or high) pressure turbine 54. A combustor 56 is arranged between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports the bearing systems 38 in the turbine section 28. The inner shaft 40 and the outer shaft 50 are concentric and rotate via bearing systems 38 about the engine central longitudinal axis A, which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines, including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second.

Figure 2:
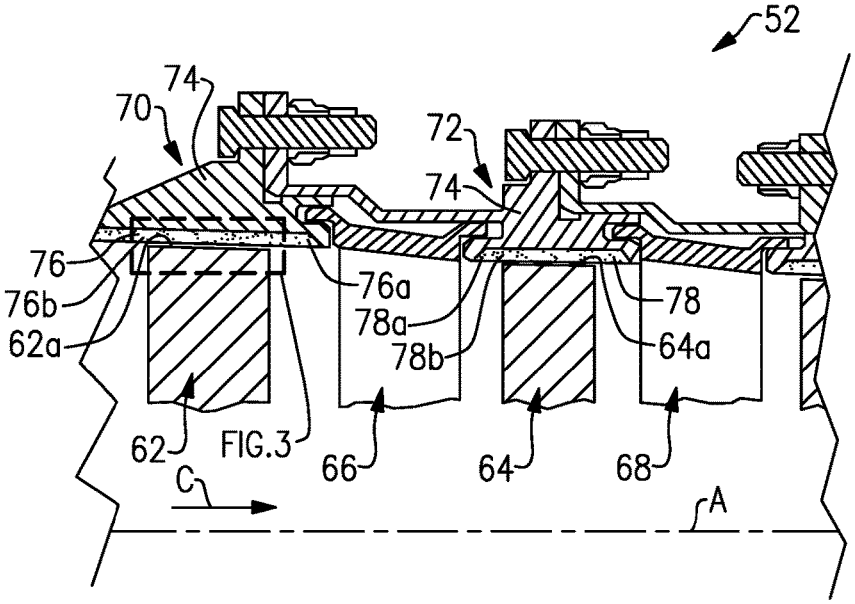
FIG. 2 illustrates a selected portion of a high pressure compressor section of an engine.

FIG. 2 illustrates a portion of the high pressure compressor 52 of the engine 20. Although the examples herein are described in the context of the high pressure compressor 52, it is to be understood that this disclosure may also be applicable to other sections of the engine, such as but not limited to, the low pressure compressor 44 and the turbine section 28. The high pressure compressor 52 generally includes circumferential rows of blades, with adjacent circumferential rows of vanes. In the example shown, the high pressure compressor 52 includes a first circumferential row of rotatable blades 62 and a second circumferential row of rotatable blades 64 (hereafter "blades" 62 or 64), with a circumferential row of vanes 66 between the blades 62/64 and another circumferential row of vanes 68 downstream from the blades 64. Generally, a row of blades and the adjacent downstream row of vanes are referred to as a "stage." In one example, the blades 62/64, and thus the seals 70/72, are within stages six to eight of the high pressure compressor 52.

The high pressure compressor 52 further includes a first seal 70 and a second seal 72 disposed about, respectively, the first and second circumferential rows of blades 62/64. Although this example is described with reference to use of both the seals 70/72 in a system, it is to be understood that either seal 70/72 could be used individually without the other in some example implementations. The seals 70/72 generally extend in a full annulus around the blades 62/64, although the seals 70/72 may be provided in multiple segments (i.e., arc segments) that are assembled into the engine 20 to form the annulus around the blades 62/64. In this example, each seal 70/72 includes a support 74 and, respectively, with first and second abradable layers 76/78 disposed on the supports 74. The seals 70/72 serve as blade outer air seals.

Figure 3:
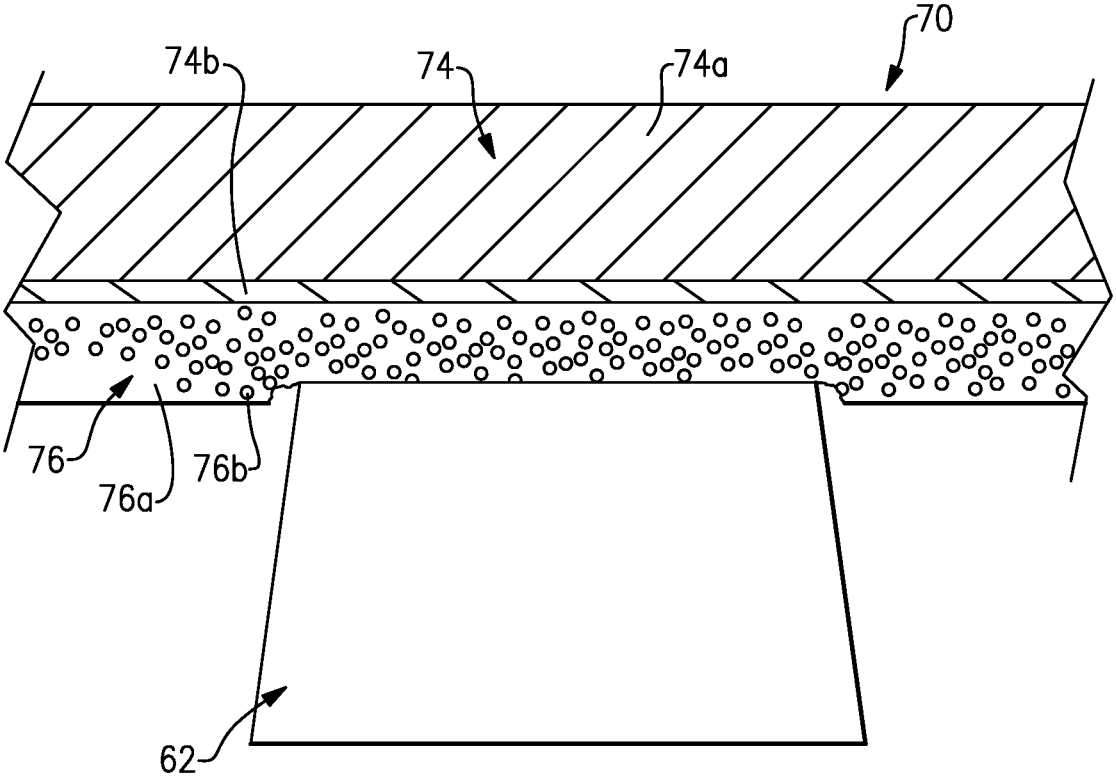
FIG. 3 illustrates a representative portion of an abradable layer.

FIG. 3 shows a representative portion of the seal 70 (and blade 62), although it is to be appreciated that the seal 72 will be similar. As shown in FIG. 3, the support 74 in this example includes a substrate 74*a* and an intermediate layer 74*b*. For example, the intermediate layer 74*b* is a bond layer that facilitates bonding between the substrate 74*a* and the abradable layer 76. Most typically, the substrate 74*a* will be a nickel- or cobalt-based alloy, and the intermediate layer 74*b* will be an oxide-forming layer, such as an aluminum-containing layer (e.g., MCrAlY).

The first abradable layer 76 includes a first metal matrix 76*a* and first microballoons 76*b* disposed in the first metal matrix 76*a*. Similarly, the second abradable layer 78 (FIG. 2) includes a second metal matrix 78*a* and second microballoons 78*b* dispersed in the second metal matrix 78*a*. As an example, each abradable layer 76/78 has, by volume, 10-60% of the respective microballoons 76*b*/78*b*. The microballoons 76*b*/78*b* are formed of respective glasses that have glass transition temperatures that are selected in accordance with a maximum temperature at the respective abradable layers 76/78 without rubbing interaction between the blades 62/64 and the abradable layers 76/78.

During operation of the engine 20, the blades 62/64 rotate about the central axis A of the engine 20. At times, tips 62*a*/64*a* of the blades 62/64 rub against the abradable layers 76/78. The blades 62/64 may be formed of alloy. The tips 62*a*/64*a* may be the bare metal alloy of the blades 62/64, or alternatively may be a hard ceramic (e.g., alumina, titanium nitride, titanium carbonitride, zirconia, abrasives in a metal matrix, etc.) or other abrasive material. The tips 62*a*/64*a* wear trenches in the respective abradable layers 76/78. The trenches provide an air seal over the tips 62*a*/64*a* of the blades 62/64.

The rubbing also produces friction, and thus heat. The heat can be conducted into the seals 70/72 and/or into the blades 62/64, and may reduce the durability of these components. In order to reduce the amount of heat produced, the glasses of the microspheres 76*b*/78*b* are selected with respect to the maximum temperature during non-rubbing (i.e., without rubbing) operation between the blades 62/64 and the abradable layers 76/78. The maximum temperature can be estimated from computer models or determined or estimated experimentally (e.g., using thermocouples), for example. In one example, the maximum temperature is based on a maximum power output condition during aircraft takeoff and initial climb. Rubbing between the blades 62/64 and the abradable layers 76/78 then raises the temperature above the glass transition temperature to promote abradability.

As used herein, a "glass" refers to an amorphous (as opposed to crystalline) solid that exhibits a glass transition temperature. The glass transition is the temperature, or range of temperature, at which the glass transitions from a hard and relatively brittle material into a softer state. The glass transition temperature may be known from literature on the type of glass, or determined experimentally using differential scanning calorimetry. One method for determining glass transition is ASTM E1356-08(2014), entitled "Standard Test Method for Assignment of the Glass Transition Temperatures by Differential Scanning Calorimetry." The glass transition temperature is always lower than the melting or liquid temperature of the crystalline state of the material, if a crystalline state exists for the material.

The glasses of the microballoons 76*b*/78*b* have glass transition temperatures that are approximately 50° F. to 300° F. above the maximum temperature during non-rubbing operation. Below the glass transition temperature, the microballoons 76*b*/78*b* are hard and strong to facilitate erosion resistance. Also, during high incursion rate rubs during which abradable layer 76/78 is removed by the blade tips 62*a*/64*a* without substantial frictional heating, the microballoons 76*b*/78*b* behave in a brittle manner, reducing contact pressure and limiting blade damage. High interaction rate rubs may be characterized by removal of about 10 microns or greater of abradable thickness per blade passage. During rubbing operation, the miroballoons 76*b*/78*b* heat to near or above their glass transition temperature. In such a temperature range, the microballoons 76*b*/78*b* soften. Thus, the rubbing with the tips 62*a*/64*a* of the blades 62/64 produces less frictional heating. In this manner, the microballoons 76*b*/78*b* can be tailored to the maximum temperature (non-rubbing) at the respective locations in the high pressure compressor (or alternatively the low pressure compressor or fan section) 52 to enhance durability for that location, as opposed to a "one-size fits all" abradable that is the same for every location.

The alloy of the metal matrices 76*a*/78*a* may be selected from nickel- or cobalt-based alloys, copper-based alloys, and aluminum-based alloys. As used herein, an alloy that is "based" on the named element means that the composition of that alloy predominantly includes that element. Thus, a nickel-based alloy is one that predominantly includes nickel. One example of a nickel- or cobalt-based alloy is MCrAlY, where M is either cobalt or nickel. One such example alloy may include, by weight, 12-22% cobalt, 5-15% chromium, 5-15% aluminum, 0-1% yttrium, and a balance of nickel. The amount of aluminum plus chromium may be greater than 15%. In further examples, the alloy may also include additive elements, such as hafnium and silicon. In one example, hafnium and silicon are individually present in an amount of up to 1%.

One example of copper-based alloy includes, by weight, at least 35% copper. In a further example, the copper-based alloy includes 30-45% of a combined amount of nickel, cobalt, and iron, with a combined amount of iron and cobalt being at most one-third of the amount of nickel, 2-8% aluminum, and 5-15% chromium. The copper-based alloy may also include additive elements, such as niobium, molybdenum, tantalum, tungsten, and rhenium. These elements may be present in amounts up to 0.5%. In a further example, the copper-based alloy may include up to 1% each of hafnium, silicon, and yttrium.

One example of an aluminum-based alloy is the eutectic composition with silicon which is aluminum plus 12% silicon by weight. Alloys from the family of Cu—Ni—Cr—Al could also be used (e.g., 40% nickel by weight, 7% aluminum by weight, 7% chromium by weight, and the balance copper). Table I below lists additional example aluminum-based compositions. In each, aluminum is the balance and is the majority, by weight percent, of the composition. Even more particularly, aluminum is substantially the remainder/balance (e.g., enough of the remainder to avoid significant compromise in properties).

TABLE I

| | W/A | Element | | | | Co/(Cr + | I-Phase |
|---|---|---|---|---|---|---|---|
| Example | % | Cr | Mn | Co | Zr | Mn) | %* |
| 1 | W | 3.7-5.2 | 2.1-3.0 | 0.4-0.6 | 0.7-1.1 | | |
| | A | 1.9-2.9 | 1.0-1.6 | 0.18-0.3 | 0.2-0.4 | | |
| 2 | W | 3.5-5.5 | 1.9-3.2 | 0.3-0.8 | 0.5-1.2 | | |
| 3 | W | 3.0-6.0 | 1.5-4.0 | 0.1-1.0 | 0.3-1.5 | | |
| 4 | W | 3.0-6.0 | 1.5-4.0 | 0.1-3.5 | 0.3-2.0 | | |
| 5 | W | 4.96 | 2.84 | 3.14 | 1.5 | | 28 |
| | A | 2.76 | 1.49 | 1.54 | 0.48 | 0.362 | |
| 6 | W | 3.7 | 2.1 | 0.42 | 0.99 | — | 20 |
| | A | 1.995 | 1.082 | 0.2 | 0.304 | 0.063 | |
| 7 | W | 4.59 | 2.63 | 0.51 | 0.99 | — | 25 |
| | A | 2.495 | 1.353 | 0.245 | 0.307 | 0.064 | |
| 8 | W | 5.12 | 2.93 | 0.57 | 0.98 | — | 28 |
| | A | 2.795 | 1.514 | 0.275 | 0.305 | 0.064 | |

In one example, the matrices 76*a*/78*a* are the same alloy, with respect to alloy composition. For instance, the matrices 76*a*/78*a* have the same composition of nickel-based alloy. A "composition" of an alloy is often defined by a grade specification that sets forth defined ranges of elements that are in that grade of alloy. Thus, the same composition includes two compositions that both fall within the grade specification.

Each microballoon of the microballoons 76*b*/78*b* is, most typically, a hollow, substantially spherical structure. These are sometimes also referred to as hollow microspheres or hollow glass microspheres or spheres. If the microballoons 76*b*/78*b* are polymer, each microballoon 76*b*/78*b* may be solid or hollow. The microballoons 76*b*/78*b* may typically have a size range of approximately 1 micrometer in diameter to approximately 100 micrometers in diameter. The microballoons 76*b*/78*b* may also have independent monodisperse size distributions, although multimodal dispersions may also be used.

The microballoons 76*b*/78*b* are glasses that are selected from fused quartz, soda-lime glass, fluoroaluminate glass, borosilicate glass, tellurium dioxide glass, and thermoset polymer glass, for example. In the illustrated example, the glass of the microballoons 76*b* is different than the glass of the microballoons 78*b*, and thus the glasses have different glass transition temperatures. For instance, in the high pressure compressor section 52, higher temperatures are produced at the tips 64*a* of the blades 64 than at the tips 62*a* of the blades 62 (the blades 64 are downstream of the blades 62). Thus, the glass of the microballoons 76*b* is selected to have a lower glass transition temperature than the glass of the microballoons 78*b*. In other words, the microballoons 76*b*/78*b* are each selected in accordance with the maximum temperatures at each location in the high pressure compressor 52. Of course, other seals around other rows of blades in the high pressure compressor 52 may include similar abradable layers, with microballoons formed of different glasses that have yet different glass transition temperatures selected in accordance with the maximum temperatures at those locations.

In additional examples, the abradable layers 76/78 may additionally include a solid lubricant. For example, the solid lubricant may be, but is not limited to, boron nitride. In one example, each of the abradable layers 76/78 independently includes, by volume, up to about 10% of boron nitride particles. In one further example, the glasses of the microballoons 76*b*/78*b* are selected such that the glass transition temperatures of the glasses differ by at least 200° F. For example, a fused quartz may have a glass transition temperature of approximately 2200° F., borosilicate glasses with a glass transition temperature of approximately 1509° F. (which can be modified by dopants of B, Na, Al), soda-lime glass 968-1112° F. (which can be modified by dopants of Na, Ca, Mg, Al), fluoroaluminate approximately 752° F., and tellurium dioxide approximately 536° F. Thermoset polymer may have a glass transition temperature that is even lower. Additionally, sode-lime glass compositions may be modified with additions of silica and/or alumina to tailor the glass transition temperature.

The microballoons 76*b*/78*b* in the abradable layers 76/78 may also serve as a barrier to gas permeability. For instance, an abradable layer that has open, interconnected porosity is prone to gas permeation through such porosity. However, the microballoons 76*b*/78*b* provide the low density of a pore but also serve as a barrier to permeation, unlike an open pore. The microballoons 76*b*/78*b* may also serve to enhance erosion resistance and provide self-lubrication as a filler in the abradable layers 76/78. This, in turn, may reduce wear on the tips 62*a*/64*a* of the blades 62/64.

The abradable layers 76/78 may be fabricated using known thermal spray techniques. Plasma spray is one such technique in which an alloy powder is fed into a plasma plume that melts the powder such that droplets of the alloy deposit onto the substrate. Here, the alloy will be of the composition selected for the metal matrices 76*a*/78*a*. To incorporate the microballoons 76*b* or 78*b*, the microballoons 76*b* or 78*b* can also be fed into the plume. To reduce the potential for the microballoons to shatter or melt, the microballoons 76*b* or 78*b* can be fed at a point further away from the plasma spray gun nozzle than where the powder metal is fed. At such a location further away, the temperatures of the plume are lower and the kinetic energy imparted to the microballoons is also lower to prevent shattering.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A gas turbine engine comprising:

a circumferential row of blades, the blades having respective blade tips; and a seal disposed about the blades, the seal having an abradable layer which the tips of the blades, at times, rub against when the blades rotate, there being a maximum temperature at the abradable layer without rubbing, the abradable layer including, a metal matrix, and microballoons dispersed in the metal matrix, the microballoons being formed of a glass having a glass transition temperature that is approximately 50° F. to 300° F. greater than the maximum temperature.

2. The gas turbine engine as recited in claim 1, wherein the metal matrix is formed from an alloy and the alloy is a nickel- or cobalt-based alloy.

3. The gas turbine engine as recited in claim 1, wherein the alloy is copper-based alloy.

4. The gas turbine engine as recited in claim 1, wherein the alloy is aluminum-based alloy.

5. The gas turbine engine as recited in claim 1, wherein the glass is fluoroaluminate glass.

6. The gas turbine engine as recited in claim 1, wherein the glass is tellurium dioxide glass.

7. The gas turbine engine as recited in claim 1, wherein the glass is borosilicate glass.

8. The gas turbine engine as recited in claim 1, wherein the glass is soda-lime glass.

9. The gas turbine engine as recited in claim 1, wherein the glass is fused quartz glass.

10. The gas turbine engine as recited in claim 1, wherein the abradable layer has, by volume, 10-60% of the microballoons.

11. The gas turbine engine as recited in claim 1, wherein the abradable layer further comprises a lubricant.

12. The gas turbine engine as recited in claim 1, wherein the circumferential row of blades are part of a compressor or turbine section of the gas turbine engine.

13. The gas turbine engine as recited in claim 11, wherein the lubricant is boron nitride.

14. The gas turbine engine as recited in claim 13, wherein the abradable layer includes up to about 10% by volume of boron nitride particles.

15. The glass turbine engine as recited in claim 2, wherein the alloy is MCrAlY, wherein M is either cobalt or nickel.

16. The gas turbine engine as recited in claim 15, wherein a combined amount of aluminum and chromium is greater than 15% by weight.

17. The gas turbine engine as recited in claim 3, wherein the alloy includes at least 35% of copper by weight.

18. The gas turbine engine as recited in claim 4, wherein the alloy is a eutectic composition having 12% silicon by weight.

19. The gas turbine engine as recited in claim 4, wherein the alloy is a Cu—Ni—Cr—Al alloy.

* * * * *